US005558715A

United States Patent [19]

Abed et al.

[11] Patent Number: 5,558,715

[45] Date of Patent: Sep. 24, 1996

[54] METHOD FOR THE PURIFICATION OF A BATH FOR COATING METALLURGICAL PRODUCTS WITH A METALLIC ALLOY, AND INSTALLATION FOR THE IMPLEMENTATION OF THIS METHOD

[75] Inventors: Patrick Abed, Poissy; Marc Dauzat, Magny Cours; Jean-Marc Rouxel, Conflans Sainte Honorine; Michel Nogues, Triel sur Seine, all of France

[73] Assignee: SOLLAC, Societe anonyme, Puteaux, France

[21] Appl. No.: 181,553

[22] Filed: Jan. 14, 1994

[30] Foreign Application Priority Data

Jan. 22, 1993 [FR] France ..... 93 00761

[51] Int. Cl.[6] ..... B05C 3/00

[52] U.S. Cl. ..... 118/429; 118/423

[58] Field of Search ..... 228/262; 118/603, 118/400, 429, 423

[56] References Cited

U.S. PATENT DOCUMENTS

| | | | |
|---|---|---|---|
| 3,084,650 | 4/1963 | Johns | 228/262 |
| 3,277,566 | 10/1966 | Christensen | 228/262 |
| 3,430,332 | 3/1969 | Roczey-Koller | 228/262 |
| 3,689,049 | 9/1972 | Brumajen et al. | 266/37 |
| 3,752,381 | 8/1973 | Watson | 118/400 |
| 3,833,163 | 9/1974 | Denslow | 118/400 |
| 4,275,098 | 6/1981 | Gunj et al. | 118/603 |
| 4,476,805 | 10/1984 | Higuchi et al. | 118/603 |
| 4,541,358 | 9/1985 | Spigarelli et al. | 118/602 |

FOREIGN PATENT DOCUMENTS

| | | | |
|---|---|---|---|
| 964691 | 4/1950 | France . | |
| 2623778 | 12/1976 | Germany | 228/262 |
| 2715048 | 2/1990 | Germany . | |
| 2055648 | 10/1978 | Japan . | |
| 63-93850 | 4/1988 | Japan . | |
| 8800036 | 8/1988 | WIPO . | |
| 9107248 | 5/1991 | WIPO | 228/262 |

OTHER PUBLICATIONS

French Search Report For French Priority Document 9300761.

Metzger, R. H., Tapa Feed Arrangement For Advancing Connector Terminals Through An Ultrasonically Activated Solder Bath, Technical Digest, No. 44, Oct. 1976, Western Electric 1976, pp. 45–46.

*Primary Examiner*—Brenda A. Lamb

*Attorney, Agent, or Firm*—Sixbey Friedman Leedom & Ferguson

[57] ABSTRACT

The subject of the invention is a method for coating a metallurgical product, especially a steel product, in which said product is dipped into a bath of metallic alloy containing solid impurities, wherein said bath of alloy is exposed to sound vibration so as to accelerate the decantation of said impurities.

The subject of the invention is also an installation for coating metallurgical products (3), especially steel products, of the type comprising a tank (1) containing a bath (2) of metallic alloy and means (4, 5) for dipping said products (3) into said bath of alloy, wherein it also comprises means (13, 14) for exposing said bath of alloy to sound vibration.

12 Claims, 2 Drawing Sheets

METHOD FOR THE PURIFICATION OF A BATH FOR COATING METALLURGICAL PRODUCTS WITH A METALLIC ALLOY, AND INSTALLATION FOR THE IMPLEMENTATION OF THIS METHOD

FIELD OF THE INVENTION

The invention relates to the field of the coating of metallurgical products with a metallic alloy, especially the galvanizing of steel products, by dipping these products into a bath containing this alloy in the liquid state.

The galvanizing of metallurgical products, such as steel strips, is carried out by causing these products, which are stationary or moving, to dwell in a bath of molten metal which is based on zinc and which can also contain variable quantities (up to a few %) of aluminum. When they are for treating metallurgical products, these baths rapidly become supersaturated with iron, and Fe—Zn or Fe—Al—Zn intermetallic compounds precipitate. These precipitates are called "dross" and decant either toward the surface of the bath (from which they are periodically removed manually) or toward the bottom of the galvanizing tank, depending on their density relative to that of the bath of zinc alloy. This density is governed by their composition; the Fe—Al—Zn dross decants toward the surface and the Fe—Zn dross toward the bottom. The bath therefore permanently contains a relatively large quantity of dross. The consequence of this is that the dross is deposited, at the same time as the zinc alloy, onto the product to be coated and often causes serious surface appearance defects to appear in the coating.

Similar problems may more generally arise when it is desired to coat a metallurgical product with an alloy initially in the liquid state within which impurities precipitate. For example, other types of dross are also liable to form in aluminizing baths.

SUMMARY OF THE INVENTION

The object of the invention is to propose a method enabling the elimination of the solid impurities within liquid alloy baths to be accelerated, so as uniformly to obtain a satisfactory quality for the dip coatings of metallurgical products.

For this purpose, the subject of the invention is a method for coating a metallurgical product, especially a steel product, in which the said product is dipped into a bath of metallic alloy containing solid impurities, wherein said bath of alloy is exposed to sound vibration in order to accelerate the decantation of said impurities.

The subject of the invention is also an installation for coating metallurgical products, especially steel products, of the type comprising a tank containing a bath of metallic alloy and means for dipping said products into the said bath of alloy, wherein it also comprises means for exposing said bath of alloy to sound vibration.

In a preferential embodiment, said tank comprises at least one partition separating it into at least two compartments each containing either said means for dipping said metallurgical products into said bath of alloy, or said means for exposing said bath of alloy to sound vibration, and the installation also comprises means for bringing said compartments into communication.

As will be understood, the invention consists in injecting, into the tank containing the liquid metallic alloy, sound or ultrasonic waves which have the effect of accentuating the decantation of the impurities. It is particularly advised to perform this exposure to sound vibration in a zone of the tank separated by a partition from the zone where the coating takes place and to perform a continuous exchange of liquid alloy between the two compartments thus defined.

BRIEF DESCRIPTION OF THE DRAWINGS

The invention will be better understood on reading the description which follows, with reference to the following appended figures.

DESCRIPTION OF THE PREFERRED EMBODIMENTS

The inventors have discovered that exposing baths of zinc alloy, of the type of those used for galvanizing, to sound vibration very substantially accelerates the decantation of the dross. In particular, it has been possible to observe this by virtue of the dipping of small crucibles of a few cm in height containing such alloys and which had or had not been subjected to sound vibration exposure for a predetermined period. This sound vibration exposure was performed for 30 minutes by means of a vibrating plate connected to an ultrasonic emitter of 25 kHz frequency and immersed in a Zn—Fe—Al liquid alloy at 450° C. Once dipped, these crucibles and the alloy which they contained were cut in the height direction and the thickness of the dross which had accumulated in the upper portion of the crucible during the experiment was measured.

The injection of low-power (5 W) waves enables a 500 μm thick dross-enriched zone to be obtained at the surface of the crucible, as opposed to 200 μm thick in the absence of sound vibration exposure. For higher powers, that is 10 and 15 W, thicknesses of 1600 to 3600 μm are obtained for this dross-enriched zone. Under the latter conditions, it was possible to observe that this gave rise to cavitation phenomena within the liquid alloy. These are of the type to accelerate the decantation of the dross considerably.

The explanation of this acceleration of the decantation of the dross is still not completely clear. In the case where a cavitation regime is established, it is possible that the appearance of bubbles at the surface of the dross occurs, because of the release of gases dissolved in the rarefaction regions of the ultrasonic wave. When these bubbles reach a sufficient size, by coalescence, they may rapidly rise to the surface of the bath, entraining with them the dross on which they have been formed.

Figure 1:
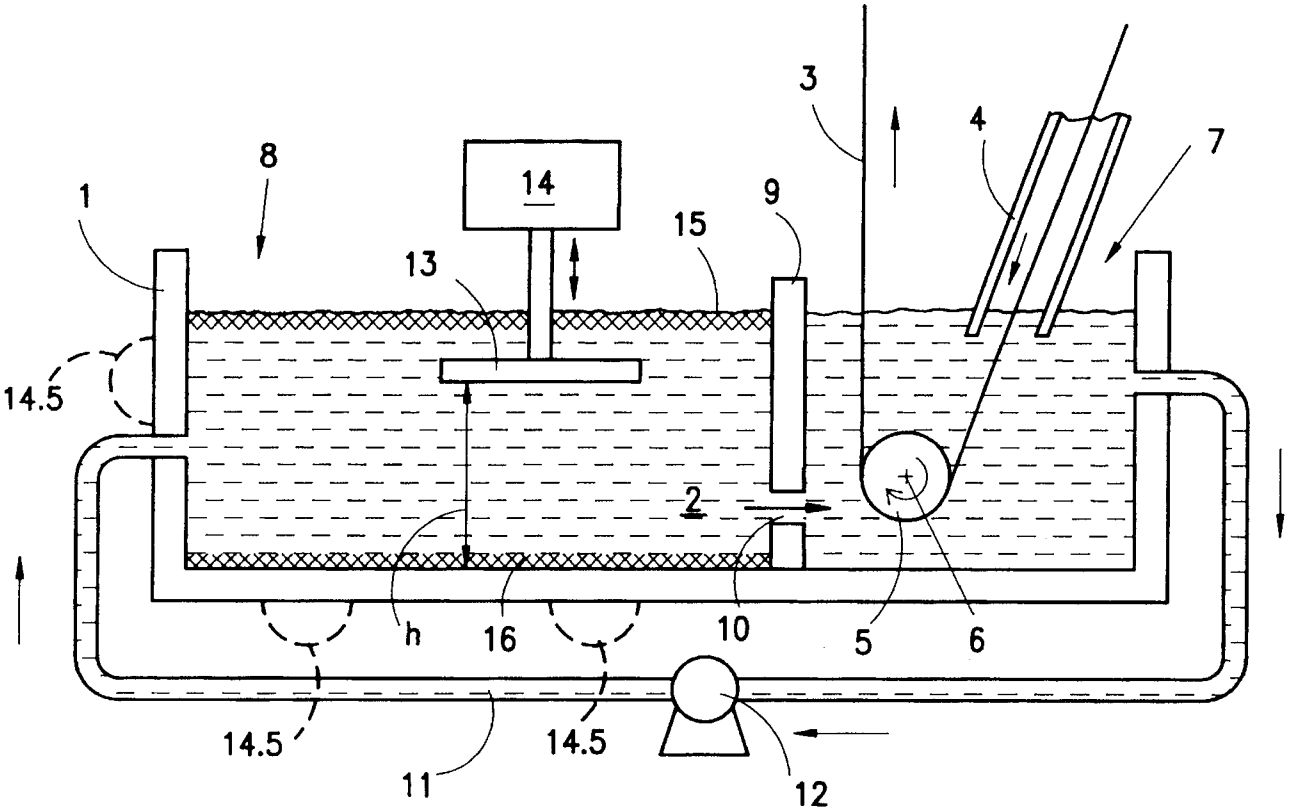
FIG. 1 which represents diagrammatically an installation for galvanizing moving steel strips which is equipped with a device for exposing the bath of alloy to sound vibration in order to implement the invention.

FIG. 1 represents diagrammatically an installation for galvanizing a moving steel strip, modified according to the invention. Conventionally, it comprises a tank 1 of a length and width of the order of several meters, containing a bath 2 of zinc alloy, of approximately 2 m in depth and maintained in the liquid state at a temperature of the order of 400°–500° C. The moving steel strip 3 penetrates into the bath 2 of alloy while being protected from ambient air by means of a bell 4, the upstream end of which is connected to the heat treatment installation which precedes the galvanizing installation, and the downstream end of which is immersed in the bath 2 of alloy. In its travel in the bath 2, the strip 3 is wound against a drum 5 rotating about its axis 6 and immersed in the bath 2. It then comes out of the bath 2 furnished with its coating of zinc alloy in the process of solidifying. According to a preferred embodiment of the invention, the tank 1 is divided into two compartments 7 and 8 by a partition 9. The compartment 7 contains the members which have just been described and constitutes the actual galvanizing compartment, whereas the compartment 8 is that where the decantation of the dross takes place preferentially by the method which is the subject of the invention. A continuous circulation of the liquid zinc alloy 2 is established between these two compartments 7 and 8 by means of one or more openings 10 made in the partition 9, and by means of a pipe 11 equipped with a pump 12 which returns the alloy taken from the galvanizing compartment 7 to the decantation compartment 8 (the reverse travel is also acceptable).

According to a first embodiment of the invention, the accelerated decantation of the dross is carried out in the decantation compartment 8 by means of a horn 13 of circular shape and of diameter of the order of 0.40 to 1 m, connected to a transducer 14, such as an electrodynamic, piezoelectric or magnetostrictive exciter. The transducer 14 imposes on the horn 13 vibrations of wavelength $\lambda$ and of frequency N=100 to 20,000 Hz approximately, and therefore in the audible range, with an amplitude of a few 1/10 mm to a few mm. Preferably, the frequency N is chosen so as to set the horn 13 into resonance and the distance "h" separating the horn 13 from the bottom of the tank 1 is chosen to be equal to an integral number of half-wavelengths $\lambda$ of the vibrations of the horn 13 so as to increase the vibratory efficiency of the installation. The electric power of the transducer 14 may be of the order of 0.3 to 10 kW. Instead of employing a single large-sized horn/transducer assembly, it is also possible to choose to use several smaller-sized ones if it is desired to obtain in this way a more homogeneous vibration of the entire bath 2 of alloy. Under these vibrations, which in principle do not enable the cavitation threshold of the bath 2 of alloy to be reached, accelerated decantation of the dross occurs. The dross of density less than the bath 2 rises to the surface in the compartment 8 and forms there a dross-enriched surface layer 15, whereas the dross of higher density than the bath 2 forms a layer 16 at the bottom of the tank 1.

Figure 2:
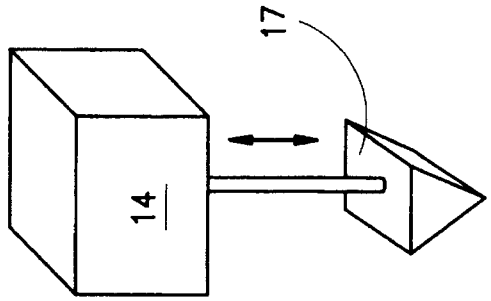
FIG. 2, which represents a variant of the sound vibration expose device.

As a variant, as shown in FIG. 2, it is possible to replace the circular horn 13 by a part 17 of tetrahedral shape set into resonance, so as to send the vibrations equally in all directions in space. Conversely, it is possible to seek to focus the vibrations so as to concentrate the injection of energy into particular regions of the bath. This may be achieved, for example, by using circular horns carrying concentric and uniformly spaced zones in relief.

It is also possible to replace the transducer 14 by one or more ultrasonic emitters 14.5, as indicated in phantom in FIG. 1. Under these conditions, it is possible to create cavitation phenomena in the bath 2 of alloy as long as its dimensions are small (of the order of a few tens of cm), or to multiply the number of emitters 14.5 so that the entire bath 2 is involved in the cavitation and not only the zones closest to the horn 13. Such ultrasonic emitters 14.5 may be held outside the bath 2 of alloy and applied on the outside of the walls of the tank 1, which avoids providing means for protecting them from attack by the bath 2 of alloy. On the other hand, there is the risk that, in the general case, the vibratory efficiency of the emitters is insufficient to obtain cavitation in the bath 2. It is therefore only possible to envisage this for very small-sized installations which would, for example, be suitable for the coating of small isolated parts.

Figure 3:
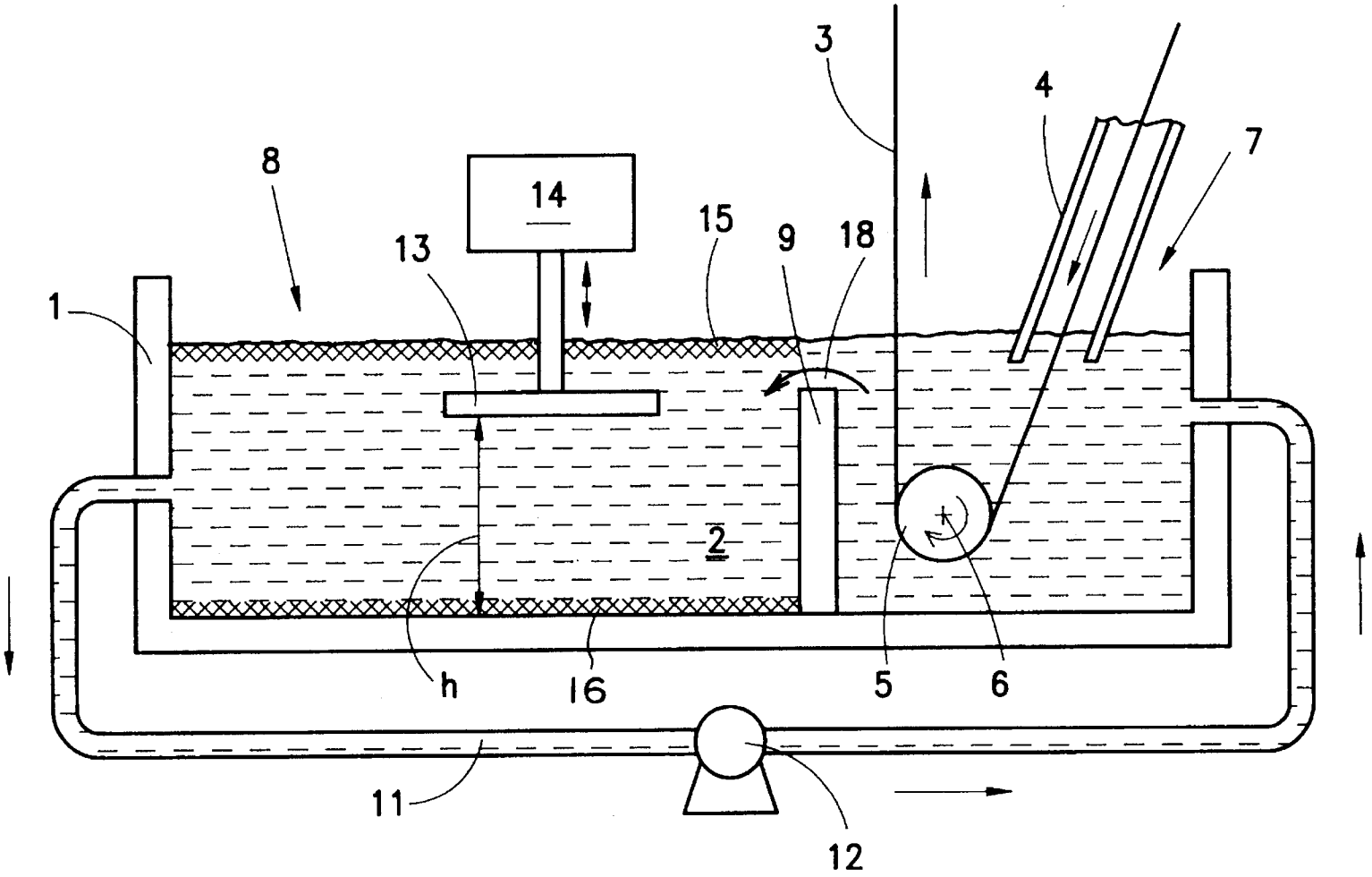
FIG. 3, which represents a variant of the installation of FIG. 1.

FIG. 3 shows a possible variation of the installation according to the invention shown in FIG. 1. The elements common to the two installations are designated by the same references. Here, the pipe 11 and the pump 12 bring the bath of alloy from the decantation compartment 8 to the galvanizing compartment 7. The return of the alloy into the decantation compartment is carried out by an overflow threshold 18 made above the partition 9, the height of which is slightly less than the nominal depth of the bath 2.

In general, it is recommended to facilitate particularly the passage, in the decantatation compartment 8, of the upper layers of the bath 2 of alloy which the galvanizing compartment 7 contains, since these layers are the richest in low-density dross liable to contaminate the coating. It is in this regard that, in the installation of FIG. 1, the pipe 11 starts in the upper portion of the galvanizing compartment 7.

Similarly, provision may also be made, in the installation of FIG. 1, to also connect the lower portion of the galvanizing bath 7 to the pipe 11, so as to further increase the cleanliness of the lower layers of the bath 2 which are liable to contain high-density dross.

Of course, modifications may be made to the installations which have just been described and shown. In particular, it is not strictly indispensable to divide the tank 1 into two compartments 7 and 8 between which the liquid alloy 2 is circulated. Nevertheless this is highly advisable so as to prevent the strip 3 from trapping a large quantity of decanted dross in its coating as it passes through the zones of the bath 2 which are close to the surface.

Conversely, it is possible to multiply the number of compartments and to provide, for example, a plurality of decantation compartments adjacent to a single galvanizing compartment, or a plurality of galvanizing compartments supplied by a single decantation compartment, or any combination of these possibilities.

It goes without saying that the invention may be applied not only to installations for continuously galvanizing steel strips, but to all installations for dip coating metallurgical products, whether moving or stationary, with a metallic alloy initially in the liquid state and liable to contain solid impurities which it is desired to eliminate.

We claim:

1. An installation for coating steel products with a zinc alloy, comprising: a tank containing a bath of a molten zinc alloy wherein the tank includes a partition for separating the bath into first and second compartments and includes circulation means for circulating dross enriched alloy from said first compartment to said second compartment; a means for dipping steel products into a portion of said bath to coat said product with said zinc alloy, wherein said dipping means is contained in said first compartment; and means for accelerating the decantation of dross iron and zinc intermetallic compounds such that said dross is separated from said first compartment, wherein said means for accelerating the decantation includes means for exposing said bath with the circulated dross enriched alloy to sound vibration for separating said dross in said with the circulated dross enriched alloy from the remainder of the zinc alloy, wherein the means for exposing said bath to sound vibration is arranged in the second compartment and wherein said means for circulation further includes means for circulating the remainder of said zinc alloy from said second compartment to first compartment.

2. The installation as claimed in claim 1, wherein said means for exposing said bath to sound vibration are constituted by at least one circular horn and connected to a transducer imposing vibrations on it.

3. The installation as claimed in claim 2, wherein said horn is held at some distance from the bottom of said tank equal to an integral number of half-wavelengths of said vibrations.

4. The installation as claimed in claim 2, wherein said transducer is an electromagnetic exciter and said vibrations have a frequency lying between 100 and 20,000 Hz.

5. The installation as claim in claim 2, wherein said transducer is a magnetostrictive exciter and said vibrations have a frequency lying between 100 and 10,000 Hz.

6. The installation as claimed in claim 2, wherein said transducer is a piezoelectric exciter and said vibrations have a frequency lying between 100 and 20,000 Hz.

7. The installation as claimed in claim 2, wherein said transducer is an ultrasonic exciter.

8. The installation as claimed in claim 1, wherein said means for exposing said bath to sound vibration are constituted by at least one part of tetrahedral shape which is dipped into said bath and connected to a transducer imposing vibrations on said part.

9. The installation as claimed in claim 1, wherein said means for exposing said bath to sound vibration is constituted by at least one ultrasonic exciter applied against a wall of said tank.

10. The installation as claimed in claim 1, wherein said circulation means circulates a remainder of zinc alloy from said second compartment to said first compartment and includes at least one pipe provided with a pump for drawing off the remainder of the zinc alloy from said second compartment and transferring the remainder of said zinc alloy to said first compartment.

11. The installation as claimed in claim 1, wherein said circulation means includes at least one opening made in said partition.

12. Installation according to claim 1, wherein said circulation means includes an overflow threshold made above said partition.

* * * * *